US008821066B1

(12) United States Patent
Caccamo et al.

(10) Patent No.: US 8,821,066 B1
(45) Date of Patent: Sep. 2, 2014

(54) SHOCK MITIGATING UNIVERSAL LAUNCH AND RECOVERY SYSTEM

(75) Inventors: Matthew P. Caccamo, Virginia Beach, VA (US); Gregory V. Gaston, Chesapeake, VA (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/536,634

(22) Filed: Jun. 28, 2012

(51) Int. Cl.
*B63C 3/02* (2006.01)
*B63B 35/40* (2006.01)

(52) U.S. Cl.
CPC ..... *B63C 3/02* (2013.01)
USPC ..... 405/1; 405/3; 114/259

(58) Field of Classification Search
CPC ..... B63B 23/30; B63B 23/32; B63C 3/00; B63C 3/02
USPC ..... 405/1, 3; 114/258, 259
See application file for complete search history.

(56) References Cited

U.S. PATENT DOCUMENTS

| | | | | | |
|---|---|---|---|---|---|
| 2,754,017 | A * | 7/1956 | Hart et al. | 405/1 |
| 3,227,292 | A * | 1/1966 | Jacobs | 405/1 |
| RE27,090 | E * | 3/1971 | Rutter | 405/3 |
| 5,259,694 | A * | 11/1993 | Byrne | 405/4 |
| 5,398,631 | A * | 3/1995 | Miller | 405/1 |
| 5,641,242 | A * | 6/1997 | Riviere | 405/3 |
| 5,855,180 | A * | 1/1999 | Masters | 114/259 |
| 6,520,728 | B1 * | 2/2003 | Schwitters | 405/3 |
| 6,602,022 | B1 * | 8/2003 | Wilkins | 405/3 |
| 6,637,975 | B2 * | 10/2003 | Foxwell | 405/1 |
| 6,779,475 | B1 * | 8/2004 | Crane et al. | 114/259 |
| 7,581,507 | B2 * | 9/2009 | Kern | 114/259 |
| 7,815,394 | B2 * | 10/2010 | Bergmann | 405/3 |
| 8,424,479 | B1 * | 4/2013 | Caccamo | 114/259 |
| 2005/0166821 | A1 * | 8/2005 | McKenzie | 114/259 |
| 2008/0202405 | A1 * | 8/2008 | Kern | 114/259 |
| 2009/0044739 | A1 * | 2/2009 | Imel et al. | 405/7 |
| 2011/0243663 | A1 * | 10/2011 | Smith | 405/3 |
| 2013/0291779 | A1 * | 11/2013 | Clarke | 114/259 |

* cited by examiner

*Primary Examiner* — Frederick L Lagman
(74) *Attorney, Agent, or Firm* — Dave A. Ghatt

(57) ABSTRACT

A universal launch and recovery system that may be used to launch or recover/receive water vessels. The launch and recovery system including a deployable ramp having a shock mitigating arrangement, including bumpers, fenders and a bow stopping guard arranged to accommodate vessels of different geometries.

8 Claims, 10 Drawing Sheets

Figure 2A
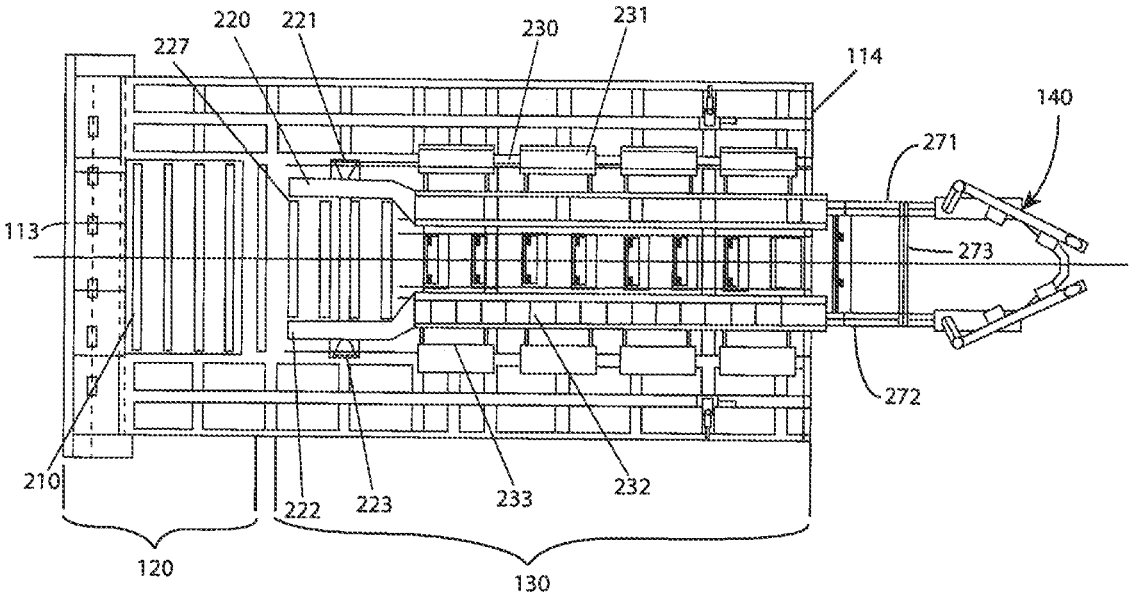
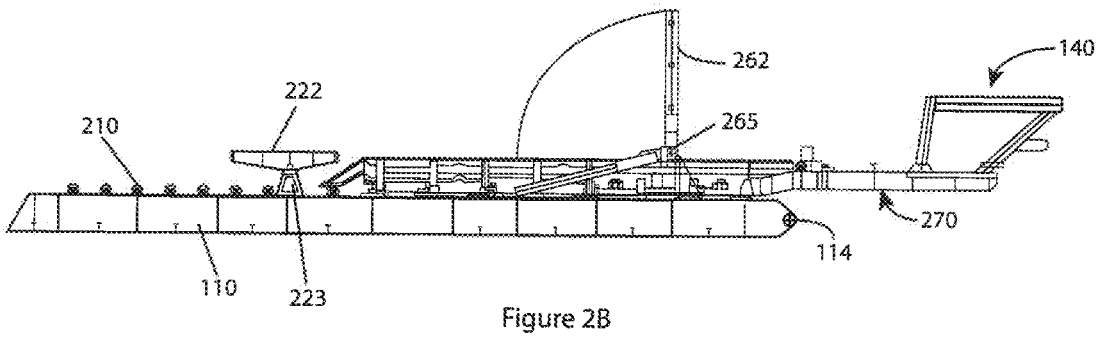
Figure 2B

SHOCK MITIGATING UNIVERSAL LAUNCH AND RECOVERY SYSTEM

STATEMENT OF GOVERNMENT INTEREST

The following description was made in the performance of official duties by employees of the Department of the Navy, and, thus the claimed invention may be manufactured, used, licensed by or for the United States Government for governmental purposes without the payment of any royalties thereon.

CROSS-REFERENCE TO RELATED APPLICATIONS

This application is related to U.S. nonprovisional patent application Ser. No. 13/034,061, filing date 24 Feb. 2011, hereby incorporated herein by reference, entitled "Universal Launch and Recovery System," by inventor Matthew Caccamo.

TECHNICAL FIELD

The following description relates generally to a universal launch and recovery system, more particularly a launch and recovery system including a deployable ramp having a shock mitigating arrangement, including fenders and a bow stopping guard arranged to accommodate vessels of different geometries.

BACKGROUND

The recovery of smaller surface water vessels, such as manned or unmanned surface water vessels (USVs), by larger parent ships is an emerging technology. Once recovered by the parent ship, servicing operations such as fueling and general maintenance may be performed. The recovery of a smaller vessel may be accomplished by driving the smaller vessel alongside a stationary parent ship and lifted by davit into the ship. Alternatively, the smaller water vessel may be driven up a ramp into the larger ship.

Traditional methods of launching and recovering/receiving smaller surface water vessels can cause damage to the hull of the smaller vessel. For example, some USVs weigh about 20,000 lbs and are made from materials such as aluminum. A recovering method that for example, requires a USV to be driven into a parent ship or be lifted and dropped onto the parent ship can cause damage to the aluminum hull, resulting in expensive repairs. The prior art does not teach operator-friendly methods and apparatuses that launch and recover smaller vessels using a plurality of fixed elements that are capable of capturing vessels having a range of different hull geometries, whilst mitigating the shock the water vessels are subjected to.

SUMMARY

In one aspect, the invention is a shock mitigating universal launch and recovery ramp system for launching and recovering a water vessel having a hull with a bow and a stern. The shock mitigating system has a pivotable ramp with a forward edge, a pivot edge, a portside edge, and a starboard edge. The forward and the pivot edges are substantially perpendicular to the portside and starboard edges, with the pivotable ramp pivotable at the pivot edge so that the ramp moves between a stowed position and deployed position for launching and receiving a water vessel. According to the invention, the pivotable ramp includes a receiving region extending from the forward edge of the ramp, the receiving region having plurality of receiving bumpers arranged substantially parallel to the forward and pivot edges of the ramp. The ramp also includes an aligning region extending from a central portion of the ramp to the pivot edge, the aligning region having portside and starboard fender rails for centrally aligning the water vessel on the pivotable ramp. The ramp further includes a projecting mount at the pivot edge of the ramp, the projecting mount having portside and starboard rails extending forwardly over the pivot edge to form a bow stopping guard that overhangs the pivot edge of the ramp.

BRIEF DESCRIPTION OF THE DRAWINGS

Other features will be apparent from the description, the drawings, and the claims.

FIG. 2A is an exemplary top view of a shock mitigating universal launch and recovery arrangement on the ramp, according to an embodiment of the invention.

FIG. 2B is an exemplary side view of a shock mitigating universal launch and recovery arrangement on the ramp, according to an embodiment of the invention.

DETAILED DESCRIPTION

Figure 1:
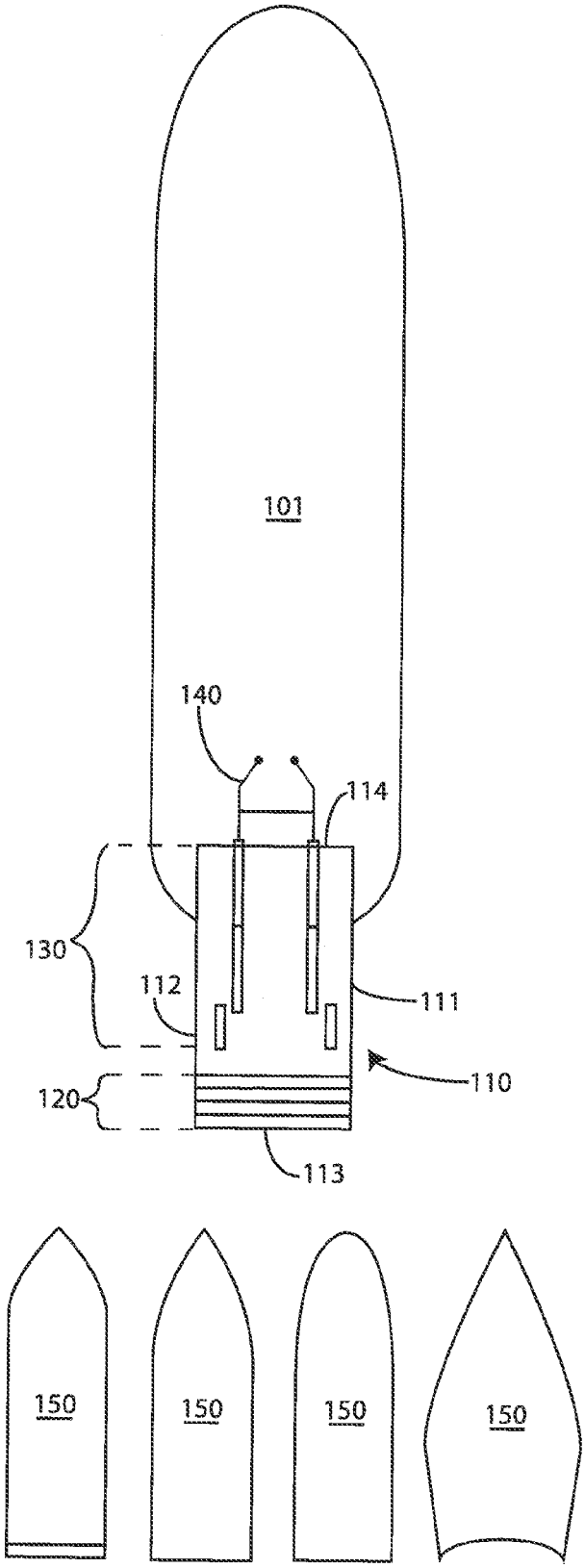
FIG. 1 is a schematic illustration of a universal launch and recovery system for launching and receiving water vessels having different geometries, according to an embodiment of the invention.

FIG. 1 is a schematic illustration of a universal launch and recovery system 100 for launching and recovering/receiving water vessels having different geometries. As shown, the launch and recovery system 100 includes a ramp 110, which as outlined below is pivotable between a stowed position and a deployed position. According to embodiments of the invention, when in the deployed position, about 50% to about 90% or more of the ramp may be submerged below the surface of the surrounding water. As illustrated, the ramp 110 has a forward edge 113, a pivot edge 114, a starboard edge 111, and a portside edge 112, with the forward and the pivot edges (113, 114) substantially perpendicular to the starboard and portside edges (111, 112). FIG. 1 schematically shows an emergency receiving region 120 extending from the forward edge 113 of the ramp 110. Also shown is an aligning region 130 extending from a central portion of the ramp to the pivot edge 114. FIG. 1 also shows form a bow stopping guard 140 that overhangs the pivot edge 114 of the ramp 110.

FIG. 1 shows the ramp 110 attached to a parent ship 101. The parent ship 101 may be a carrier or a cargo ship for carrying one or more smaller water vessels 150 on a cargo deck. As outlined below, the ramp 110 including the emergency receiving region 120, the aligning region 130, and the bow stopping guard 140 are provided to launch and/or recover the smaller water vessels, while in open water such as in the ocean or a lake, or the like. FIG. 1 shows vessels 150 having different beams and generally different hull geometries. The vessels 150 are provided merely as examples of a myriad of smaller vessels having different geometries, which could be launched or received by the parent ship 101. The water vessel 150 may be any type of vessel that can be carried by the parent ship 101, and may be manned or unmanned. Additionally, as opposed to a parent ship 101, the ramp 110 may be attached to a fixed structure, such as a loading dock, and would thus facilitate the launching and recovering of vessels from and to fixed structures.

Figure 2C:
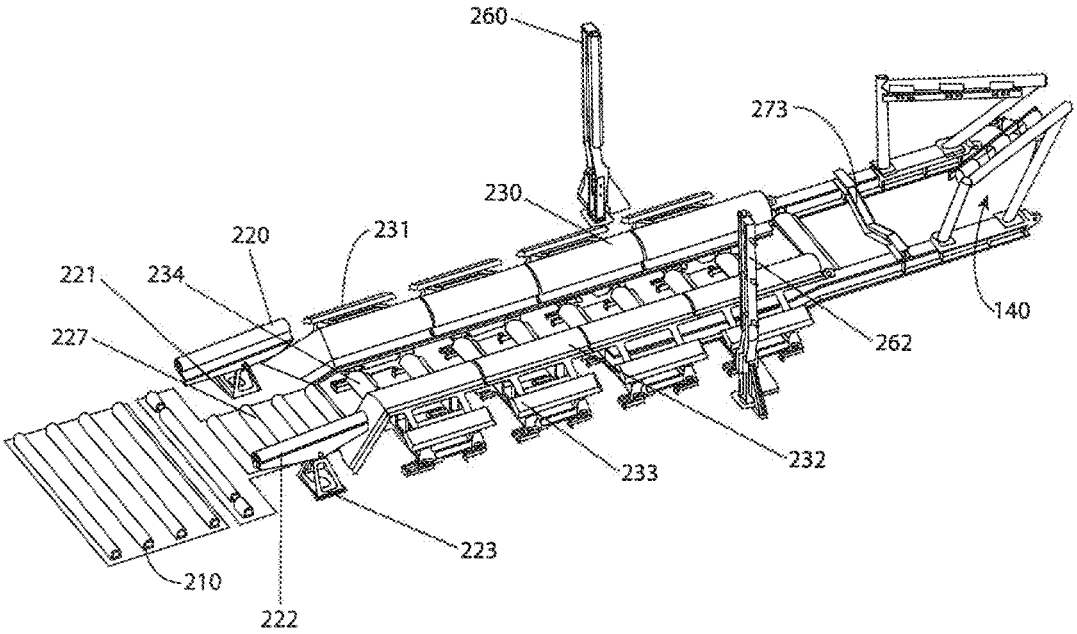
FIG. 2C is an exemplary perspective illustration of the shock mitigating universal launch and recovery arrangement with the ramp removed.

FIGS. 2A-2B are exemplary illustrations of the shock mitigating universal launch and recovery arrangement 100 on the ramp, according to an embodiment of the invention. FIG. 2C is an exemplary perspective illustration of the shock mitigating universal launch and recovery arrangement 100 with the ramp 110 removed. FIG. 2A is a top perspective view of the arrangement 100, and shows the emergency receiving region 120 having plurality of receiving bumpers 210 at the forward edge 113. As shown, the bumpers 210 are elongated and are arranged substantially parallel to the forward and pivot edges (113, 114) of the ramp 110. FIG. 2B is a side view and shows the bumpers 210 fastened to the upper surface of the ramp 110, thereby forming protrusions. The bumpers may preferably be formed from an elastomeric material or the like, which helps to mitigate shock associated with launching and/or receiving water vessels 150 thereon. As outlined below, the arrangement of the bumpers 210 is generally transverse to the travelling direction of water vessel that is being received or launched. Typically in the deployed position, about 50% to about 90% or more of the ramp 110 may be submerged below the surface of the surrounding water. Thus water vessels 150 do not usually contact the bumpers during launching or recovery operations, however in the event of a severe drop in the water level on account of the sea state and/or the motion of the ship 101, the water vessel may contact the bumpers 210. Under these conditions during receiving operations, the bumpers 210 slow down the speed of the vessels being received, and during launching operations, the bumpers 210 prevent uncontrolled slippage down the ramp 110.

Figure 2D:
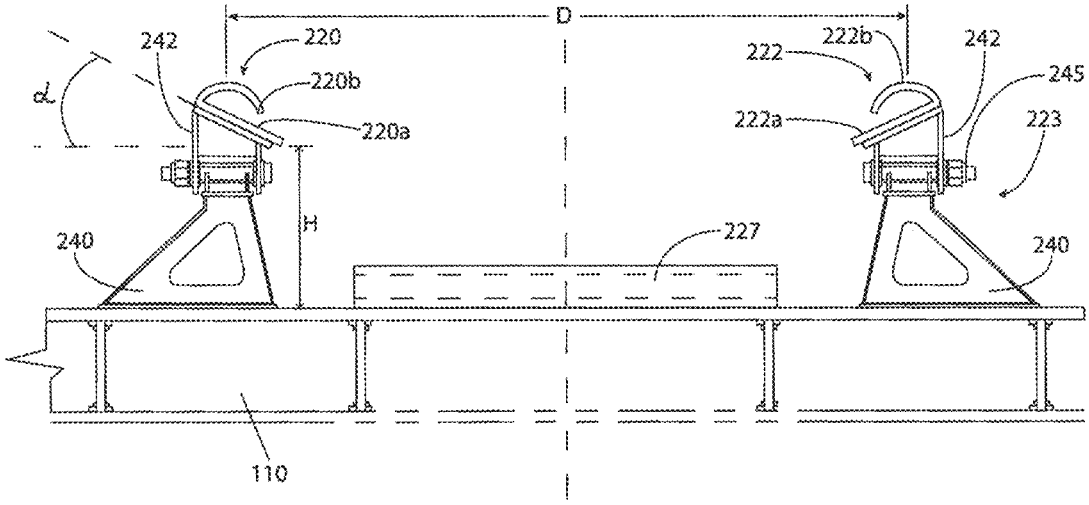
FIG. 2D is a sectional illustration, showing the resilient arrangement of the first pair of fenders, according to an embodiment of the invention.

FIGS. 2A and 2B also show the aligning region 130 extending from a central portion of the ramp to the pivot edge 114. As shown, the aligning region 130 includes a first pair of matching fenders having a portside fender 220 and a starboard fender 222. FIGS. 2A and 2C show secondary bumpers 227 positioned between the fenders (220, 222), and having a similar orientation to receiving bumpers 210. The bumpers 227 are placed between the fenders (220, 222) for situations involving water vessels 150 that have a deep V-shaped hull. The bumpers 227 would allow the keel of the water vessels 150 to make contact with the bumpers 227 instead of hitting the ramp, thereby protecting the hull from damage. The portside fender 220 is mounted on a support 221 and the starboard fender 222 is mounted on a support 223. The supports (221, 223) may be made from a material such as aluminum, or the like. FIG. 2D is a sectional illustration of the first fender arrangement, showing the structure of the fenders (220, 222) being substantially identical, as is the respective supports (221, 223). As shown in FIG. 2D, the starboard fender 220 is connected to the ramp via the support 221. Similarly, the portside fender 222 is connected to the ramp via the support 223. FIG. 2D shows the supports (221, 223) having a base support 240 and a top support 242. The top support 242 is connected to the base support by a shoulder bolt 245. This arrangement allows for the rotation of the top support 242 with respect to the base support. Because the fenders (220, 222) are connected to the respective top support 242, the fenders (220, 222) are also rotatable about the longitudinal axis of the shoulder bolt 245, and therefore could be adjusted if desired. FIG. 2D also shows one of the plurality of secondary bumpers 227 located between the fenders (220, 222).

Figure 2E:
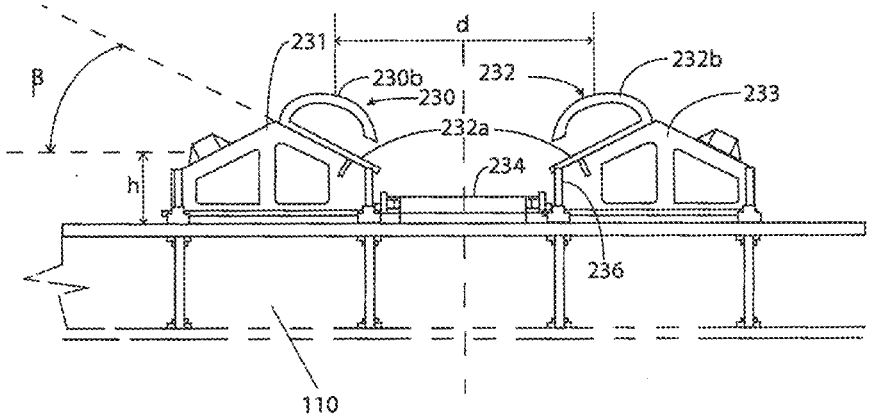
FIG. 2E is a sectional illustration, showing the resilient arrangement of the second pair of elongated fenders, according to an embodiment of the invention.

FIGS. 2A, 2B, and 2C show the aligning region 130 having a second pair of fenders, the second pair including an elongated portside fender 230 and an elongated starboard fender 232. FIG. 2E is a sectional illustration of the second pair of fenders, showing the structure of the fenders (230, 232) being substantially identical, as is the respective rail supports (231, 233). As illustrated in FIGS. 2A and 2B, the elongated fenders (230, 232) extend from a central portion of the ramp 110 to the pivot edge 114 of the ramp 110. The fenders (230, 232) may be divided into segments having elongated lengths $l_1$, $l_2$, $l_3$, and $l_4$, as shown in FIG. 2A. As shown in FIGS. 2B and 2E, the elongated fenders (230, 232) are mounted to the ramp 110 via rails (231, 233). The rails (231, 233) may be detachably secured to the ramp 110. As shown in FIGS. 2A and 2B, the elongated fenders (230, 232) are about four times the length of the fenders (220, 222). FIGS. 2A and 2D also show centerline fenders 234 located between the elongated fenders 230 and 232, and oriented in a direction similar to that of the bumpers 210 and 227. According to an embodiment of the invention, the centerline fenders 234 are substantially cylindrical in shape. As shown in FIG. 2E, the centerline fenders 234 are positioned closer to the ramp surface than the elongated fenders (230, 232). The centerline fenders are supported at extreme ends at opposing side surfaces 236 of the rails 235.

FIG. 2D shows the distance D between the first pair of fenders (220, 222). FIG. 2E shows the distance d between the elongated fenders (230, 232). As evidenced by view of FIG. 2A, the distance D is greater than the distance d. According to an embodiment of the invention, the distance D may be about 70 inches to about 75 inches, and the distance d may be about 45 to about 50 inches. According to a preferred embodiment D is about 72.5 inches, and d is about 48 inches. As outlined below, the respective lengths of the first pair of fenders (220, 222) and the second pair of fenders (230, 232), and the distance (D, d) between complimentary fenders allow for an initial alignment of water vessels 150 at the first pair of fenders (220, 222) and a second more complete alignment at the second pair of fenders (230, 232) during recovery operations. In addition to aligning water vessels 150, the first and second pairs of fenders also mitigate the shock forces associated with the launch and/or recovery of water vessels 150.

The arrangement also allows for the accommodation of water vessels 150 having different hull geometries.

FIGS. 2D and 2E are sectional illustrations, showing the resilient arrangements of the respective fenders, according to an embodiment of the invention. Both the first pair of fenders (220, 222) and the second pair of fenders (230, 232) have hook-like sections having a substantially C-shaped portion and a straight portion that provide resiliency. For example, as shown in FIG. 2D, the fenders (220, 222) have a flat bottom plate portion (220*a*, 222*a*) a substantially C-shaped upper plate portion (220*b*, 222*b*) connected to the straight flat bottom plate portion (220*a*, 222*a*) forming a continuous resilient fender. In operation the water vessel 150 is primarily supported on the C-shaped upper plate portion, and the relative flexing at the free end of the C-shaped upper plate towards the flat bottom plate portion 222*a* (as shown by arrow A), providing the desired resiliency. As shown in FIG. 2D, top supports 242 each have a flat upper surface, at which the flat bottom plate portions (220*a*, 222*a*) are attached. As shown, the flat upper surface of each top support 242 is angled at an angle $\alpha$ relative to the horizontal. The combination of the angle $\alpha$, the distance D between the fenders 220 and 222, and the height H of the fenders (220, 222) above the ramp surface, all allow for the accommodation of vessels 150 having different beams and generally different hull geometries. According to an embodiment of the invention, the angle $\alpha$ may be about 25 degrees to about 30 degrees, and the height H may be about 15 inches to about 20 inches.

Figure 3B:
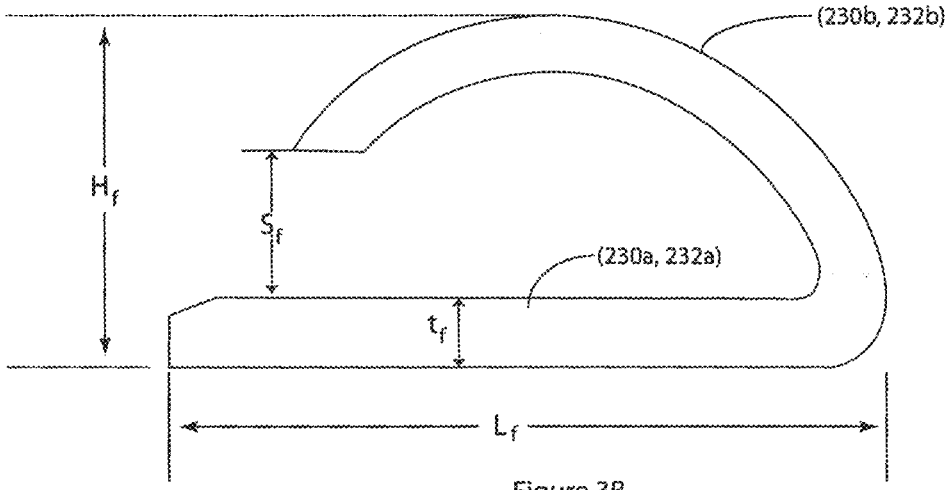
FIG. 3B is an exemplary sectional illustration of the substantially identical second pair of elongated fenders.
Figure 3A:
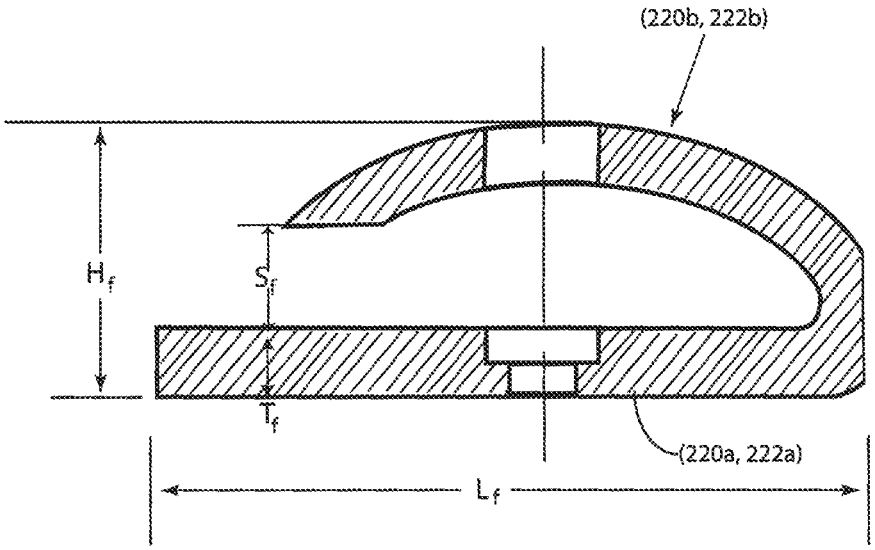
FIG. 3A is an exemplary sectional illustration of the substantially identical first pair of fenders.

According to an embodiment of the invention, the fenders (220, 222) are made from an ultra high molecular weight polyethylene (UHMW) material. FIG. 3A is an exemplary sectional illustration of the substantially identical fenders (220, 222), showing exemplary dimensions. As shown in FIG. 3A, the flat bottom plate portion (220*a*, 222*a*) has a length $L_F$, and a height $H_F$. FIG. 3A also shows the fenders (220, 222) having a non-stressed separation $S_F$ between the flat bottom plate portion (220*a*, 222*a*) and the substantially C-shaped upper plate portion (220*b*, 222*b*). The fenders (220, 222) also have a material thickness $T_f$. FIG. 2A shows the fenders (220, 222) having a longitudinal length $L_f$. According to an embodiment of the invention, $L_1$ is about 50 inches, $L_F$, is about 10 inches, $H_F$ is about 3.5 inches, $T_f$ is about 0.625 inches, and SF is about 1.375 inches.

FIG. 2E shows the springs (230, 232) a flat bottom plate portion (230*a*, 232*a*) a substantially C-shaped upper plate portion (230*b*, 232*b*) connected to the straight flat bottom plate portion (230*a*, 232*a*) forming a continuous resilient fender. In operation the water vessel 150 is primarily supported on the C-shaped upper plate portion, and the relative flexing at the free end of the C-shaped upper plate towards the flat bottom plate portion 222*a* (as shown by arrow B), providing the desired resiliency. As shown in FIG. 2E, rail supports 235 each have a flat upper surface, at which the flat bottom plate portion (230*a*, 232*a*) are attached. The rails 235 may be made from a material such as aluminum or the like. As shown, the flat upper surface of each top support 242 is angled at an angle $\beta$ relative to the horizontal. The combination of the angle $\beta$, the distance d between the fenders 230 and 232, and the height h of the fenders (230, 232) above the ramp surface, all allow for the accommodation of vessels 150 having different beams and generally different hull geometries. According to an embodiment of the invention, the angle $\beta$ may be about 27 degrees to about 33 degrees, and the height H may be about 6 inches to about 12 inches.

According to an embodiment of the invention, the fenders (230, 232) are made from an ultra high molecular weight polyethylene (UHMW) material. FIG. 3B is an exemplary sectional illustration of the substantially identical elongated fenders (230, 232), showing exemplary dimensions. As shown in FIG. 3B, the flat bottom plate portion (230*a*, 232*a*) has a length $l_f$, and a height $h_f$. FIG. 3B also shows the fenders (230, 232) having a non-stressed separation $s_f$ between the flat bottom plate portion (230*a*, 232*a*) and the substantially C-shaped upper plate portion (230*b*, 232*b*). The fenders (230, 232) also have a material thickness $t_f$. FIG. 2A also shows the fenders (230, 232) having longitudinal length sections $l_1$, $l_2$, $l_3$, and $l_4$. According to an embodiment of the invention, $l_1$, $l_2$, and $l_3$ are about 48 inches, and $l_4$, is about 58 inches. Additionally, according to this embodiment, $l_f$, is about 18.5 inches, $h_f$ is about 8.5 inches, $t_f$ is about 0.75 inches, and $s_f$ is about 4.0 inches.

The aligning region also includes a portside stanchion 260 and a starboard stanchion 262. The stanchions (260, 262) are illustrated in FIGS. 2B and 2C. As shown in FIG. 2B, the stanchions may pivot about a hinge 265 to move from a substantially vertical orientation to a substantially horizontal orientation. The stanchions 260 and 262 are provided on either side of the fenders 230 and 232, respectively. The stanchions (260, 262) when deployed in the substantially vertical orientation provide additional support for water vessels 150, being launched and/or received, depending on the size of the water vessel 150. The stanchions (260, 262) also provides operators with a visual as to the location of the ramp 110, allowing for the centering of the water vessel 150 during recovery operations. The stanchions (260, 262) may have an aluminum frame with Delrin® rollers.

FIGS. 2A, 2B, and 2C also show the bow stopping guard 140 that overhangs the pivot edge 114 of the ramp 110. As shown, the bow stopping guard 140 is supported on a projecting mount 270 at the pivot edge 114 of the ramp 110. The projecting mount 270 includes portside 271 and starboard 272 rails extending forwardly over the pivot edge 114 to form the bow stopping guard 140. FIGS. 2A and 2C also shows a crossbar support 273 connecting the portside 271 and starboard 272 rails.

Figure 4A:
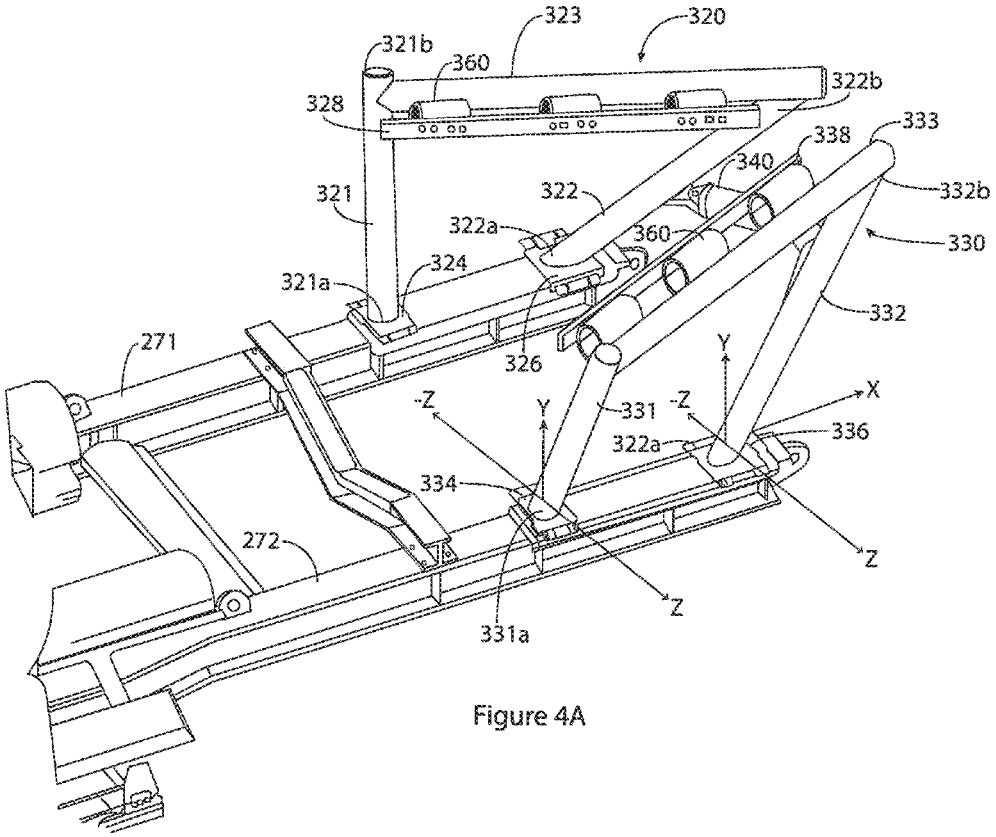
FIG. 4A is a perspective illustration showing the elements of the bow stopping guard, according to an embodiment of the invention.

FIG. 4A is a perspective illustration showing the elements of the bow stopping guard 140. FIG. 4A shows the bow stopping guard 140 having a portside pipe structure 320, a starboard pipe structure 330, and an angled pipe 340 connecting the portside and starboard structures 320 and 330. As shown in the top view of FIG. 2A, this arrangement has a shape that is complementary to the bow of a water vessel 150, and therefore can cushion the bow of the water vessel therein without causing damage to the water vessel.

As shown in FIG. 4A, the portside and starboard pipe structures 320 and 330 are substantially identical. The portside pipe structure 320 includes a first upwardly extending pipe 321 having a lower end 321*a* connected to the portside rail 271 via an attachment plate 324. The portside pipe structure 320 includes a second upwardly extending pipe 322 having a lower end 322*a* connected to the portside rail 271 via an attachment plate 326. A third pipe 323 is connected to the upper end 321*b* of pipe 321, and to the upper end 322*b* of pipe 322. Similarly, the starboard pipe structure 330 includes a first upwardly extending pipe 331 having a lower end 331*a* connected to the starboard rail 272 via an attachment plate 334. The starboard pipe structure 330 includes a second upwardly extending pipe 332 having a lower end 332*a* connected to the starboard rail 272 via an attachment plate 336. A third pipe 333 is connected to the upper end 331*b* of pipe 331, and to the upper end 332*b* of pipe 332.

Figure 4B:
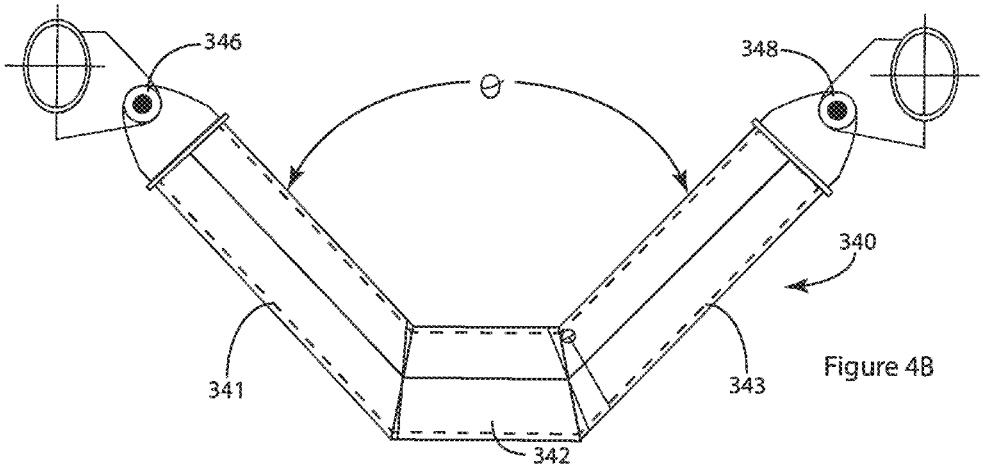
FIG. 4B is an exemplary illustration of the angled pipe of the bow stopping guard, according to an embodiment of the invention.

FIG. 4A also shows the angled pipe 340 extending from the portside pipe structure 320 to the starboard pipe structure 330. The angled pipe 340 extends from about a midpoint of the second upwardly extending pipe 322 to about the midpoint of the second upwardly extending pipe 332. FIG. 4B is an exemplary illustration of the angled pipe 340. As shown, the angled pipe 340 includes three straight sections 341, 342, and 343, joined to form the angular structure. As shown, according to an embodiment of the invention, pipe sections 341 and 343 are connected to section 342 to provide a flare angle θ. According to an embodiment of the invention, the flare angle θ may be about 90 degrees to about 120 degrees FIG. 4B also shows the connector structures 346 and 348 at the extreme ends to connect the angled pipe 340 to the second upwardly extending pipers 322 and 332. According to an embodiment of the invention, the connector 348 may include a push pipe for releasably attaching to the pipe 332. The connector 346 may be attached by means of a bolt of the like to provide a more fixed connection to the pipe 322.

Figure 4C:
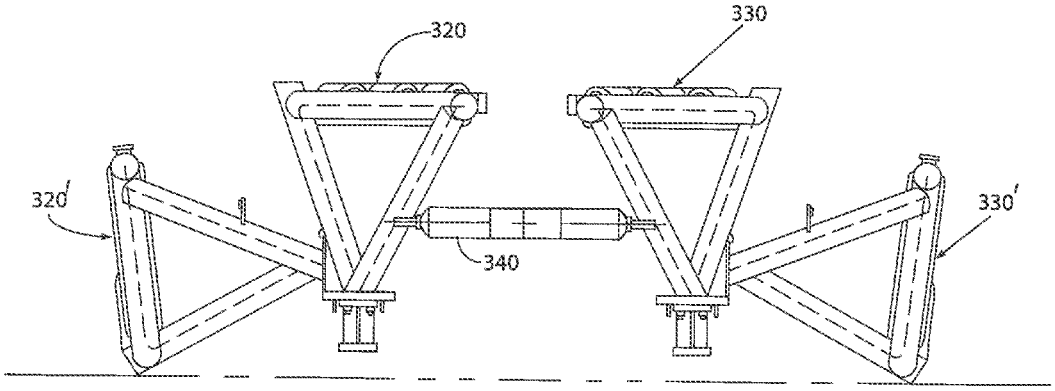
FIG. 4C is an exemplary illustration showing pivotable elements of the bow stopping guard, according to an embodiment of the invention.

The releasable connector 348 may be provided to release the angled pipe 340 from the upwardly extending pipe 332. When released, both the portside pipe structure 320, and the starboard pipe structure 330 may pivot outwards, independently. Regarding the starboard pipe structure 320, the outward pivoting may be achieved by pivotally connecting the out edges of attachment plates 324 and 326. Similarly, regarding the portside pipe structure 330, the outward pivoting may be achieved by pivotally connecting the outer edges of attachment plates 334 and 336 to the respective rails 271 and 272. FIG. 4C shows the structures 320 and 330 in the deployed positions and also in the pivoted stowed positions 320' and 330'.

As outlined above, the bow stopping guard 140 has a shape that is complementary to the bow of a water vessel 150. In order to provide this complimentary shape, the portside and starboard pipe structures 320 and 330 are angled as illustrated. For example, regarding the starboard pipe structure 330, as shown in FIG. 4A, using the XYZ coordinate reference system, both the upwardly extending pipes 331 and 332 lean forward in the +X direction. Pipe 331 also leans forward in the +Z direction, whereas pipe 332 leans backwards in the −Z direction. The portside pipe 320 structure mirrors the starboard pipe structure 330. Thus, in the directions from the lower ends (321*a*, 331*a*) towards the upper ends (321*b*, 331*b*), the pipes 321 and 331 extend away from each other. Whereas, in the directions from the lower ends (322*a*, 332*a*) towards the upper ends (322*b*, 332*b*), the pipes 322 and 332 extend towards each other. This skewed pipe formation of the pipe structures 320 and 330, in combination with the angled connecting pipe 340 provides the bow-complimentary shape of the bow stopping guard 140.

FIG. 4A also illustrates reinforced upper pipes 323 and 333. As shown the pipes each include shock isolators 360, which may be made from a shock absorbing material. FIG. 4A also shows outer plates 328 and 338 attached to the shock isolators, thereby sandwiching the isolators between the outer plates (328, 338) and the upper pipers (323, 333). This arrangement further helps to mitigate the shock associated particularly with receiving a water vessel 150 at the bow stopping guard 140.

The above-outlined structure facilitates the launch and/or recovery of water vessels 150. In operation the ramp 110 is deployed to a position in which the forward edge 113 is submerged beneath the surrounding water. The ramp 110 may be moved by using a hydraulic/pneumatic arrangement. The deployed position in which the forward edge 113 is submerged allows for a smooth transition from the ramp 110 to the water during launching operations, or from the water to the ramp 110 during recovery operations. As outlined above, the ramp is designed to receive water vessels 150 of various hull geometries, and also to mitigate the shock associated with launch and recovery operations.

During receiving/recovery operations, the selected water vessel 150 is directed towards the ramp at a low velocity. When the parent ship 101 is at rest, the selected water vessel 150 is directed at a preferred speed of about 5 to 8 about knots. If the parent ship is moving, the preferred speed is about 5 to about 8 knots faster than the moving ramp. If the water vessel 150 approaches the ramp at a speed slower than about 5 knots, an operator may attach a skiff hook to the bow eye and pull the water vessel 150 up onto the ramp 110. Water vessels 150 traveling at speeds greater than about 8 knots will engage internal brakes that will slow the vessel 150 to a manageable speed.

Figure 5A:
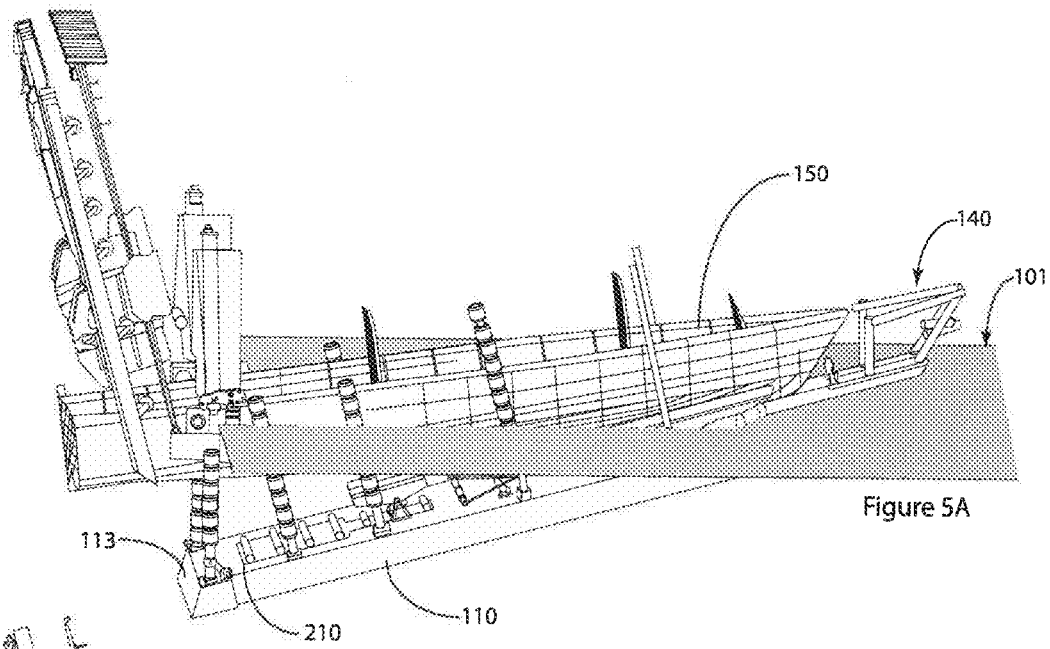
FIG. 5A is an exemplary perspective illustration of a water vessel being launched or recovered on a deployed ramp, according to an embodiment of the invention.
Figure 5B:
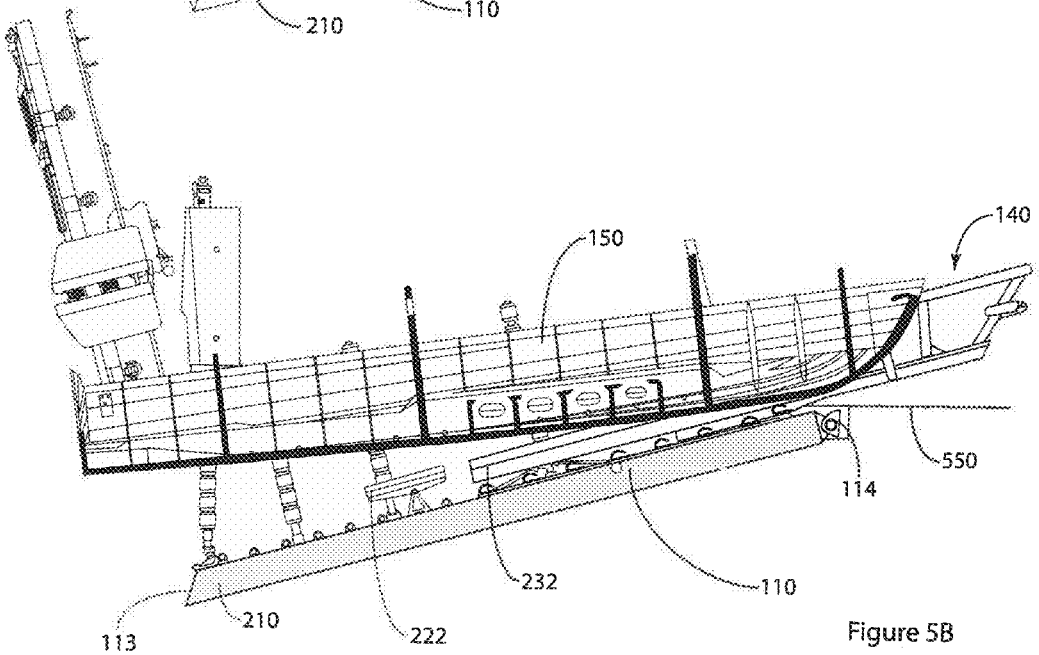
FIG. 5B is an exemplary perspective illustration of a water vessel being launched or recovered on a deployed ramp, according to an embodiment of the invention.

The above stated velocities provide the initial momentum necessary to climb the ramp 110. FIGS. 5A and 5B are exemplary perspective illustrations of a water vessel 150 being launched or recovered on the ramp 110. As outlined above, in the deployed position, about 50% to about 90% or more of the ramp may be submerged below the surface of the surrounding water. FIG. 5B shows the waterline 550, which is at or above 90% of the ramp 110. Consequently, the water vessels 150 would not contact the bumpers 210 during launching or recovery operations. However, the bumpers are positioned at the forward edge 113 for emergency situations where there is a severe drop in the water level on account of the sea state and/or the motion of the ship 101. In those circumstances, the water vessel may contact the bumpers 210. Thus, during receiving/recovery operations, the bumpers 210 slow down the speed of the vessels being received and prevents damage to the hull of the water vessel 150. By braking the speed of the water vessel being recovered, the bumpers 210 also reduce the possibility of injury to sailors working on these launch or recovery operations. The elastomeric material of the bumpers 210 also mitigates shock associated with recovery operations.

Figure 5C:
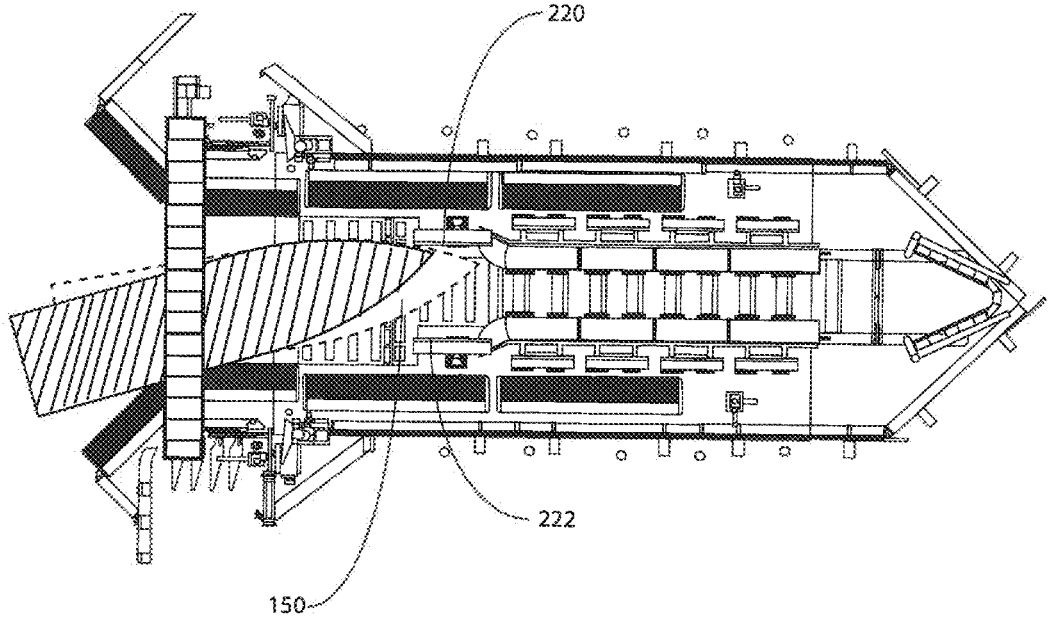
FIG. 5C shows the orientation of the water vessel when the vessel initially contacts the first pair of fenders.

During receiving/recovery operations, the water vessel 150 typically first contacts the first pair of fenders (220, 222). When the bow of the water vessel 150 contacts the first pair of fenders (220, 222), the water vessel 150 undergoes an initial alignment. FIG. 5C is an explanatory illustration, showing the alignment of the water vessel 150 caused by contact with the first pair of fenders (220, 222), according to an embodiment of the invention. FIG. 5C shows the orientation of the water vessel 150 in solid lines, when the vessel 150 initially contacts the pair of fenders (220, 222). The alignment is due to the contact and the point loading at the fenders (220, 222). The alignment-adjusted position of the water vessel 150 after contact with the first pair (220, 222) is shown in dashed lines. As shown, a central longitudinal axis 520 of the vessel 150 is more closely aligned with the longitudinal axis 510 of the ramp 110. It should be noted that in embodiments in which the water vessel 150 contacts the bumpers 210, the water vessel 150 would typically contact the first pair of fenders (220, 222) in a similar fashion as outlined above, and a similar alignment takes place at the fenders (220, 222).

Figure 5D:
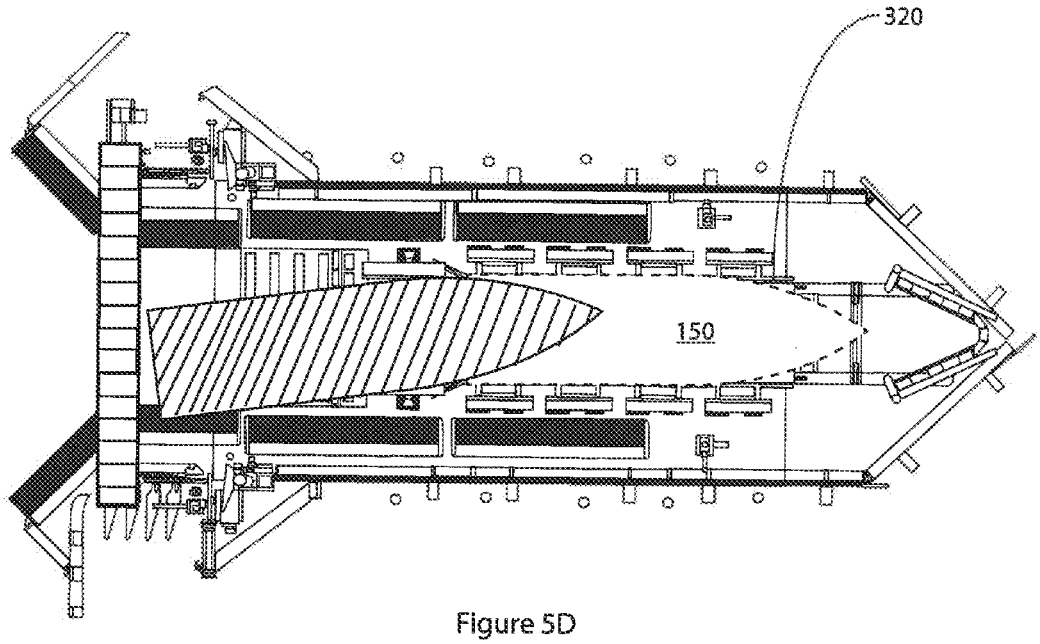
FIG. 5D shows the orientation of the water vessel when the vessel initially contacts the second pair of fenders.

After contacting the first pair of fenders (220, 222) and undergoing an initial alignment, the water vessel 150 continues up the ramp 110 and contacts the elongated fenders (230, 232). As outlined above, the first fenders (220, 222) are separated from each other by a distance D, which is greater than the separation d of the second pair of fenders (230, 232). This difference in separation distances allows for a funneling alignment as the water vessel moves from the first pair of fenders (220, 222) to the second pair of fenders (230, 232). FIG. 5D is an explanatory illustration, showing the alignment of the water vessel 150 caused by contact with the second pair of fenders (230, 232), according to an embodiment of the invention. FIG. 5D shows the orientation of the water vessel 150 in solid lines, when the vessel 150 initially contacts the pair of fenders (230, 232). The alignment-adjusted position of the water vessel 150 after contact with the elongated pair of fenders (230, 222) is shown in dashed lines. As shown, a central longitudinal axis 520 of the vessel 150 is even more closely aligned with the longitudinal axis 510 of the ramp 110. Additionally, as the water vessel moves up on the ramp 110, more load is supported on the elongated fenders (230, 232), distributing the load throughout the arrangement. Transverse centerline fenders 234 also supports the weight of the water vessel 150 due to any bobbing of the hull of the water vessel 150 as it contacts and rides along the elongated fenders (230, 232).

As the water vessel 150 moves up the elongated fenders (230, 232) its speed is reduced, and it may come to a stop. However, the initial velocity may force the water vessel 150 further up the ramp, until it contacts the bow stopping guard 140. FIG. 5E shows the orientation of the water vessel 150, when the vessel 150 contacts and comes to rest at the bow stopping guard 140. As shown the vessel 150 is aligned so that it the central longitudinal axis 520 is closely aligned with the longitudinal axis of the ramp 110. As shown, in the final position, the bow of the water vessel overhangs the pivot edge of the ramp 110, which allows for easy access to the deck of the parent ship 101, if the water vessel is to be stored on the deck. As outlined above, according to an embodiment of the invention, the bow stopping guard may be pivoted downwards, allowing the vessel 150 to be pulled onto the deck of the parent ship 101.

During launching operations, the ramp is moved into the deployed position as shown above in FIGS. 5A and 5B. The water vessel 150 is lowered down the ramp under the force of its own weight. Because the water vessel 150 is typically starting from a stationary position on the elongated fenders (230, 232), the elongated fenders initially guide the water vessel down the ramp 110. The first fenders (220, 222) provide further guidance down the ramp and into the water. As outlined above, typically the water vessel 150 does not contact the bumpers 210 in the emergency receiving region 120 during launching operations. However, if during launching there is a severe and sudden drop in the water level due to the seat state and/or the motion of the ship 101, the water vessel may contact the bumpers 210 which would then prevent uncontrolled slippage down the ramp 110, preventing damage to the hull of the water vessel 150. The elastomeric material of the bumpers 210 also mitigates shock associated with launch and recovery operations.

It should be noted that the arrangement of the launch and recovery system 100 allows for receiving water vessels 150 having different hull geometries. For example, the distances D and d between the respective fenders (220, 222) and (230, 232) allow for water vessels 150 having beams of about 7 ft to about 12 ft. Other dimensions outlined above, also allow for the accommodation of vessels 150 having these different geometries. For example, the dimensions of the fenders 220, 222, 230, and 232 outlined above, and the arrangement of the bow stopping guards also allow for receiving different hull geometries.

What has been described and illustrated herein are preferred embodiments of the invention along with some variations. The terms, descriptions and figures used herein are set forth by way of illustration only and are not meant as limitations. Those skilled in the art will recognize that many variations are possible within the spirit and scope of the invention, which is intended to be defined by the following claims and their equivalents, in which all terms are meant in their broadest reasonable sense unless otherwise indicated.

What is claimed is:

1. A shock mitigating universal launch and recovery ramp system for launching and recovering a water vessel having a hull with a bow and a stern, comprising:

a pivotable ramp having a forward edge, a pivot edge, a portside edge, and a starboard edge, with the forward and the pivot edges substantially perpendicular to the portside and starboard edges, the pivotable ramp pivotable at the pivot edge so that the ramp moves between a stowed position and deployed position for launching and receiving a water vessel, the pivotable ramp comprising:

a receiving region extending from the forward edge of the ramp, the receiving region having plurality of receiving bumpers arranged substantially parallel to the forward and pivot edges of the ramp;

an aligning region extending from a central portion of the ramp to the pivot edge, the aligning region having portside and starboard fender rails for centrally aligning the water vessel on the pivotable ramp; and a projecting mount at the pivot edge of the ramp, the projecting mount comprising portside and starboard rails extending forwardly over the pivot edge to form a bow stopping guard that overhangs the pivot edge of the ramp wherein the portside and starboard fender rails comprise;

a first pair of fenders having a portside fender and a starboard fender; and a second pair of fenders having an elongated portside fender and an elongated starboard fender, wherein a distance D between the first pair of fenders is greater than a distance d between the second pair of fenders, and wherein during a recovery the first pair of pivotable fenders initially contact a bow portion of the water vessel thereby performing an initial alignment of the water vessel, then guiding the water vessel towards the second pair of elongated fenders where the alignment is completed by the second pair of fenders, and wherein the second pair of fenders receive and support substantially the entire water vessel thereon, and wherein the pivotable ramp further comprises a pair of elongated support rails having a portside rail support and a starboard rail support each of the pair of elongated rail supports having a flat upper surface, and wherein the portside elongated fender is mounted on the portside rail support, and the starboard elongated bumper is mounted on the starboard rail support, and wherein the each of the elongated portside and starboard fenders comprise:

a flat bottom plate portion attached to the flat upper surface of the respective elongated rail; and a substantially C-shaped upper plate portion connected to the flat bottom plate portion forming a continuous resilient bumper, wherein the hull of the water vessel is resiliently supported on the substantially C-shaped upper plate portion of each of the elongated portside and starboard fenders.

2. The shock mitigating universal launch and recovery ramp system of claim 1, wherein the pivotable ramp further comprising a pair of adjustable supports, including a portside support and a starboard support, each support comprising:

a base support;

a shoulder bolt; and a top support having a flat upper surface, the top support connected to the base support via the shoulder bolt allowing for the rotation of the top support with respect to the base support about the shoulder bolt;

and wherein the portside fender is mounted on the portside support, and the starboard fender is mounted on the starboard support, and wherein the each of the portside and starboard fenders comprise:

a flat bottom plate portion attached to the flat upper surface of the respective top support; and a substantially C-shaped upper plate portion connected to the flat bottom plate portion forming a continuous resilient fender.

3. The shock mitigating universal launch and recovery ramp system of claim 2, wherein the bow stopping guard comprises:

a pair of raised pipe structures including a portside pipe structure and a starboard pipe structure, each pipe structure comprising:

a first upwardly extending pipe extending upwards from the respective rail of the projecting mount;

a second upwardly extending pipe extending upwards from the respective rail of the projecting mount; and a third pipe extending from the first pipe to the second pipe;

and wherein bow stopping guard further comprises a fourth pipe connecting the portside pipe structure to the starboard pipe structure.

4. The shock mitigating universal launch and recovery ramp system of claim 3, wherein the fourth pipe is an angled pipe comprising, first, second, and third straight pipe sections, wherein the first straight pipe section and the third straight pipe sections are connected to the second pipe section at opposite ends of the second straight pipe section, thereby providing the fourth pipe with a flare angle θ of about 90 degrees to about 120 degrees.

5. The shock mitigating universal launch and recovery ramp system of claim 4, wherein each third pipe of the respective portside and a starboard pipe structures further comprise a plurality of shock isolators and an outer plate, the outer plate and the third pipe sandwiching the plurality of shock isolators therebetween.

6. The shock mitigating universal launch and recovery ramp system of claim 5, further comprising a plurality of attachment plates, wherein each of the upwardly extending pipes are attached to the respective portside and starboard rail via one of the plurality of attachment plates, and wherein each of the attachment plates are pivotally connected with respect to the respective portside and starboard rail, said pivotal connection allowing each of the portside and starboard pipe structures to pivot between a stowed position and a deployed position.

7. The shock mitigating universal launch and recovery ramp system of claim 6, further comprising a plurality of short bumpers between a first pair of fenders, the short bumpers arranged substantially parallel to the forward and pivot edges of the ramp.

8. The shock mitigating universal launch and recovery ramp system of claim 7, further comprising a plurality of centerline fenders between the second pair of fenders, wherein the centerline fenders are arranged substantially parallel to the forward and pivot edges of the ramp and are supported at extreme ends at opposing side surfaces of the rails.

* * * * *